United States Patent [19]

Castro, Jr. et al.

[11] Patent Number: 4,821,441

[45] Date of Patent: Apr. 18, 1989

[54] MULTISHOT UNDERWATER SURVIVAL GUN

[76] Inventors: Manuel Castro, Jr., 7736 Textile Rd., Ypsilanti, Mich. 48197; Bruce Bush, 598 Lambkins, Saline, Mich. 48176

[21] Appl. No.: 148,853

[22] Filed: Jan. 27, 1988

[51] Int. Cl.[4] ..... F41C 9/06

[52] U.S. Cl. ..... 42/1.14; 42/59

[58] Field of Search ..... 42/1.14, 59

[56] References Cited

U.S. PATENT DOCUMENTS

| | | | |
|---|---|---|---|
| 3,453,763 | 7/1969 | Barr et al. | 42/1.13 |
| 3,494,060 | 2/1970 | Hendricks | 42/1.14 |
| 3,545,117 | 12/1970 | Voorhees | 42/1.14 |
| 3,616,561 | 11/1971 | Hendricks | 42/1.14 |
| 3,721,031 | 3/1973 | Falterman et al. | 42/1.14 |
| 3,729,853 | 5/1973 | Critcher | 42/1.14 |
| 4,122,621 | 10/1978 | Barr | 42/1.14 |

*Primary Examiner*—Deborah L. Kyle
*Assistant Examiner*—Michael J. Carone
*Attorney, Agent, or Firm*—James M. Deimen

[57] ABSTRACT

An underwater gun comprises a multi-chambered head attached to a long handle. The handle includes a rotatable section connected to the head to manually index the cylinder, sequentially chamber by chamber, into the firing position. Spring urged arms retain the cylinder in the head but with the turn of a cylinder lock ring open to permit removal and replacement of the cylinder underwater as well as above. Cartridges are held securely in the cylinder and replacement cylinders by threaded shell retainers. The extra pre-loaded cylinders can be carried by the diver underwater to reload the gun after the first cylinder has been emptied.

18 Claims, 5 Drawing Sheets

MULTISHOT UNDERWATER SURVIVAL GUN

BACKGROUND OF THE INVENTION

The field of the invention pertains to hand held underwater weapons and, in particular, to underwater multishot spear guns. Such guns generally comprise a head having one or more firing chambers and a long shaft handle. The guns are carried by divers in waters where shark attack is a possibility. Shells are fired by impacting the head against the target, typically an umnderwater predator such as a shark.

Single chamber impact actuated guns are disclosed in U.S. Pat. No. 3,274,936, U.S. Pat. No. 3,664,052 and U.S. Pat. No. 4,100,692. These patents disclose various means for constructing the chamber and, in particular, the firing mechanism. Unfortunately, if the first shot is not successful, reloading underwater in sufficient time to avert disaster may not be possible.

Because of the need for repeat shots without reloading, multishot weapons have been developed. U.S. Pat. No. 3,616,561 discloses a multiple long bore gun wherein the barrels are rotatable in the manner of a long cylinder and the firing pin is trigger actuated. Such a gun is unduly complicated and unwieldy.

A multiple shot gun with a rotatable cylinder head for firing bullets is disclosed in U.S. Pat. No. 3,494,060. Impacting the head against a target causes firing of a bullet and indexing the next chamber and bullet into position. U.S. Pat. No. 3,545,117 and U.S. Pat. No. 3,721,031 each disclose rotatable cylinder heads with large chambers for shotgun shells and fired by impact. Although multiple shot capability is provided, the cylinders cannot easily be replaced underwater.

With a view toward a more convenient and effective multishot underwater gun wherein the cylinder can be easily exchanged underwater, applicant has invented the following device.

SUMMARY OF THE INVENTION

The new underwater survival gun comprises a multichambered head attached to a long handle. The handle includes a rotatable section connected to the cylinder in the head to manually index the cylinder, sequentially chamber by chamber, into the firing position.

The cylinder is retained in the head by spring urged latching arms that are closed into position by a cylinder lock ring. A partial turn of the cylinder lock ring permits the release of the arms and the cylinder for quick and easy replacement both above and under water.

The chambers are formed by sleeves in the cylinder each having at least a portion of the sleeve outside open for engagement by the arms. The engagement with the arms provides index positions to align the chambers sequentially in the firing position. The engagement is preferably formed to also provide intermediate safety positions for the cylinder.

The connection of the cylinder to the handle includes a spring urging the cylinder forward from the handle. The gun is thus fired by impacting the head on the target causing the cylinder to move backward and a shell in the chamber aligned for firing to contact a firing pin.

DESCRIPTION OF THE PREFERRED EMBODIMENT

Figure 1:
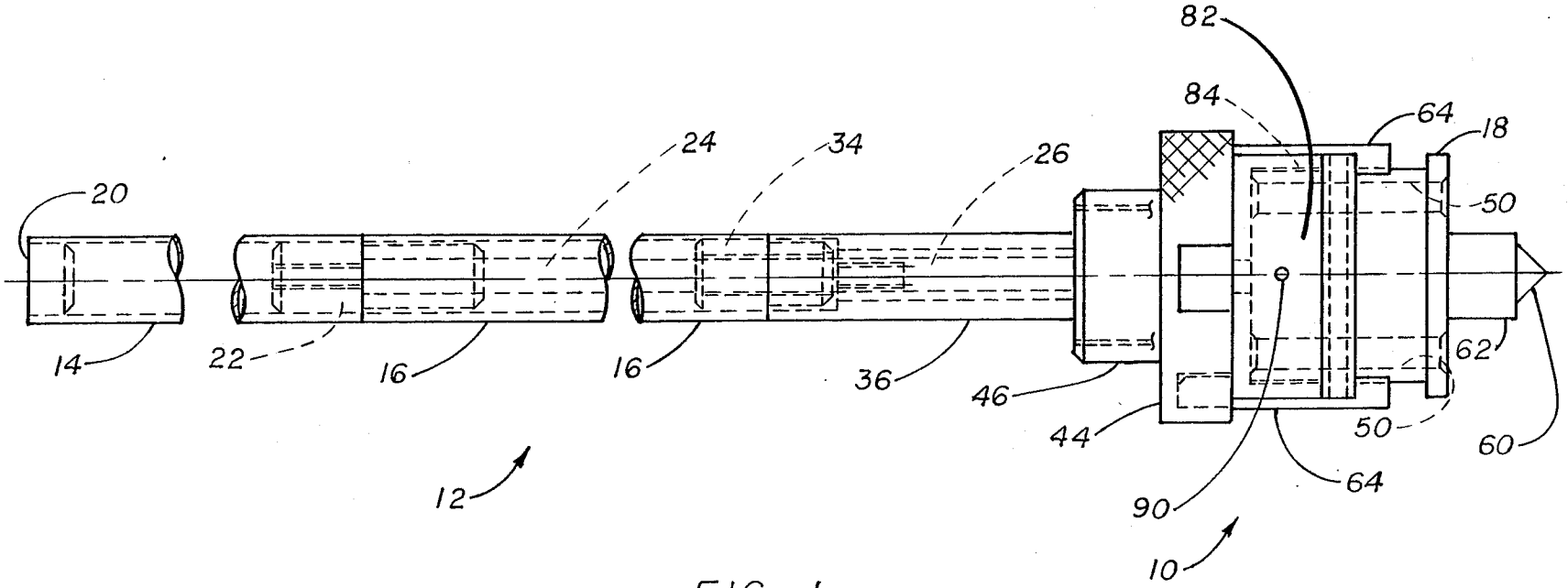
FIG. 1 is a side view of the underwater gun.
Figures 2, 2A:
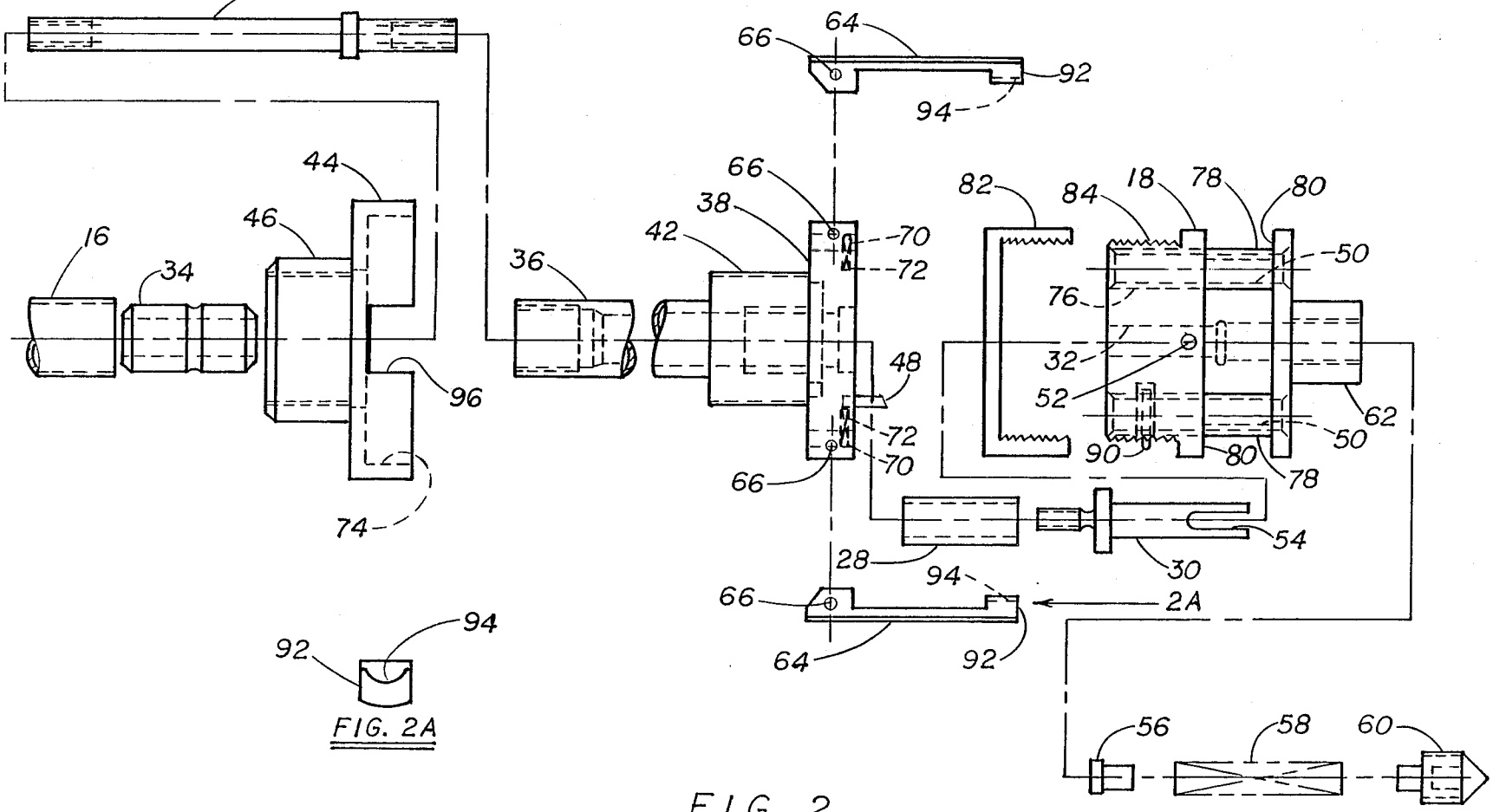
FIG. 2 is an exploded view of the head of the gun.
FIG. 2A is a detail of a latching arm in the head of the gun.
Figure 3:
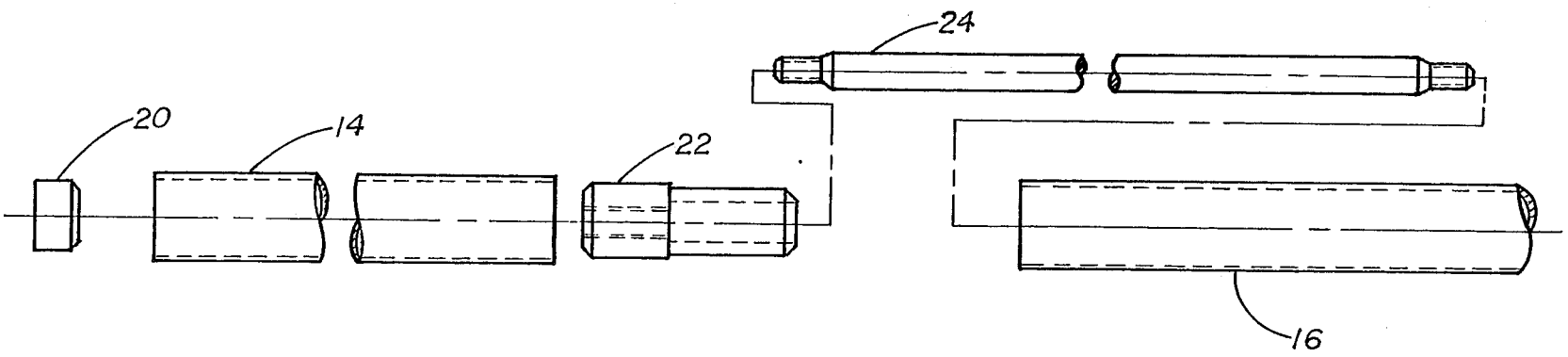
FIG. 3 is an exploded view of the tail stock of the gun.

Illustrated in FIGS. 1, 2 and 3 is the underwater gun comprising a head generally denoted by 10 and a tail stock or spear handle generally denoted by 12. The tail stock includes two external tubes 14 and 16 about three quarters of an inch in diameter and a total of about three feet in length. The tube 14 is rotatable relative to tube 16 to rotate the cylinder 18 in the head 10. The exterior of the tube 14 is knurled to provide a suitable hand grip.

Within the tail stock is an end plug 20 and a handle sleeve 22 both attached to the tube 14. Within the tube 16 and attached to the handle sleeve 22 is a first main shaft 24. At the other end of the first main shaft 24 a second main shaft 26 is attached. At the other end of the second main shaft 26 a bushing 28 surrounds the attachment of a bifurcated rod 30 which extends into the center hole 32 of the cylinder 18.

The tail stock tube 16 is attached by a main housing connector 34 to the tubular extension 36 of the back plate 38 of the head 10. The back plate 38 is suitably bored at 40 to provide support for the bushing 28 and cylinder 18. The external surface of the collar 42 of the back plate 38 is threaded for the engagement of the knurled locking ring 44 and collar 46. Offset radially from the centerline of the gun and permanently attached to the back plate 38 is a firing pin 48. The firing pin determines the firing position for each cartridge chamber 50 of the cylinder 18.

Within the cylinder 18 is a transverse pin 52 engaging the slot 54 in the bifurcated rod 30. Thus, the cylinder 18 is caused to rotate upon rotation of the tube 14. Engaging the tips of the bifurcated rod 30 is a cylinder extension stop 56. A coil spring 58 engages the stop 56 and the nose piece 60 threaded within the nose 62 of the cylinder 18. As assembled the spring 58 urges the cylinder away from the back plate 38. Upon impact with a target the cylinder 18 is forced toward the back plate 38 and firing pin 48.

Figure 6:
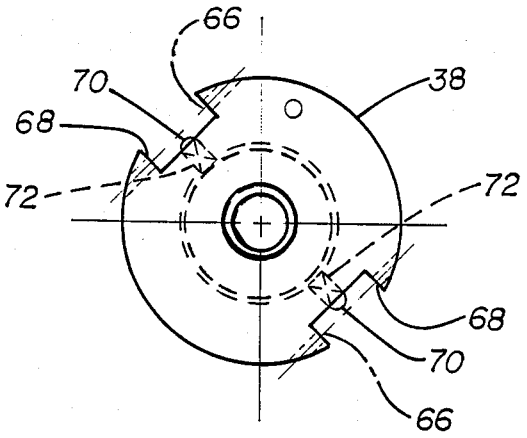
FIG. 6 is a front end veiw of the back plate.
Figure 7:
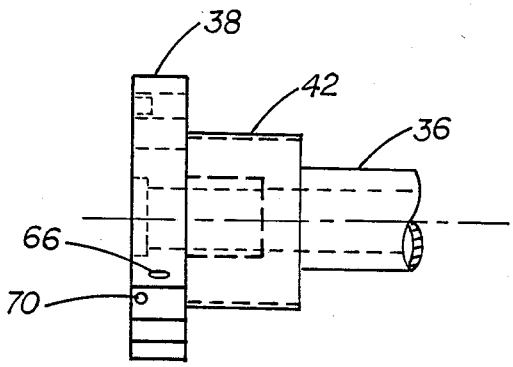
FIG. 7 is a side view of the back plate.

As shown in FIGS. 2, 6 and 7 a pair of flexible arms 64 are pivotably attached at 66 on opposite sides of the back plate 38 in slots 68. The arms are urged outwardly out of disengagement with the cylinder 18 by a pair of springs or ball detents 70 set in holes 72 in the back plate 38. The lock ring 44 flange internal surface 74 retains the arms 64 inward in engagement with the cylinder 18. The inward engagement, however, retains sufficient freedom in the flexible arms 64 to permit indexing of the cylinder 18.

Figure 4:
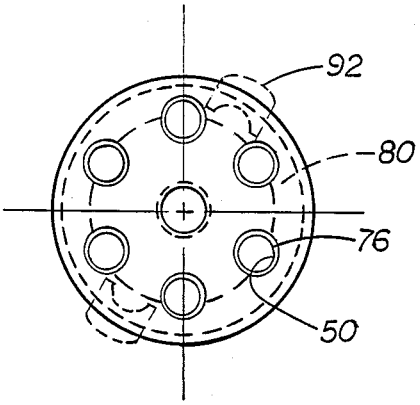
FIG. 4 is a front end view of the cylinder.
Figure 5:
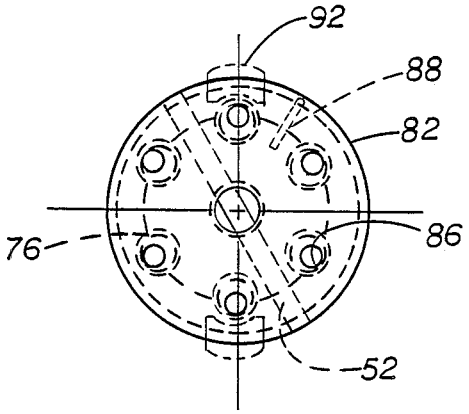
FIG. 5 is a rear end view of the cylinder.

As shown in FIGS. 2, 4 and 5 the chambers 50 in the cylinder 18 are formed by steel sleeves 76 insertd in an aluminum cylinder. The sleeves 76 are partially exposed at 78 by the circumferential groove 80 in the cylinder 18. To retain the cartridges in the chambers a shell retainer 82 is threadably engaged to the cylinder 18 at 84. The shell retainer 82 is formed with a plurality of holes 86 of a diameter less than the cartridges but of sufficient size to permit entrance of the firing pin 48. The ball detent 88 in the cylinder 18 engages a hole 90 in the shell retainer 82 only when the shell retainer 82 is fully threaded on the cylinder 18 thereby assuring that the cartridges are properly retained in the chambers 50 and the holes 86 in the shell retainer 82 are properly aligned with the chambers 50.

The forward ends 92 of the arms 64 are formed concave 94 as shown in FIG. 2A to engage the convex exposed surfaces 78 of the chamber sleeves 76. Sequential engagement of the arms 64 with the chamber sleeves 76 as the cylinder 18 is indexably rotated, sequentially aligns the chambers 50 with the firing pin 48. Indexing the cylinder into positions where the arms 64 engage the cylinder 18 between the chamber sleeves 76 as shown ghosted in FIG. 4 provides safety positions for the cylinder and gun.

The cylinder 18 may be easily removed and replaced by another cylinder by rotating the lock ring 44 until the slots 96 align with the arms 64 thereby allowing the ball detents 70 to urge the arms 64 outwardly out of engagement with the circumferential slot 80 and the chamber sleeves 76. The cylinders can then be slid from the bifurcated rod 30 and another cylinder 18 with fresh cartridges inserted on the rod 30. The arms 64 are closed and the lock ring 44 rotated to retain the arms 64 closed. Thus, the cylinders 18 can be preloaded with cartridges and easily replaced underwater if necessary.

I claim:

1. An underwater gun comprising a head and handle attached to the head, a cylinder in the head, said cylinder including a plurality of chambers, a plurality of arms engageable with said cylinder to retain the cylinder in the head, means to retain said arms in engagement with the cylinder and means to cause release of said arms from the cylinder, and said handle including a first handle portion and a second handle portion rotatable relative to the first handle portion , said first handle portion connected to said cylinder for rotation therewith.

2. The underwater gun of claim 1 including a back plate attaching the handle to the head, said arms being pivotably attached to the back plate.

3. The underwater gun of claim 2 wherein said means to cause release of said arms comprise springs on said back plate urging said arms outwardly.

4. The underwater gun of claim 2 wherein said means to retain the arms in engagement comprise a lock ring on said back plate and in engagement with the arms.

5. The underwater gun of claim 1 wherein the handle comprises a long thin substantially cylindrical form with said first handle portion spaced from the head.

6. The underwater gun of claim 1 including a back plate attaching the head to the handle, a firing pin attached to the back plate, a shell retainer on the cylinder and appertures in the shell retainer substantially alignable with the chambers in the cylinder.

7. The underwater gun of claim 6 wherein the engagement of said arms with said cylinder provides indexable alignment of the chambers sequentially with said firing pin.

8. the underwater gun of claim 7 wherein said indexable alignment engagement includes intermediate non-alignment indexable positions.

9. The underwater gun of claim 1 wherein said first handle portion connection to the cylinder comprises a tranverse pin in the cylinder, a bifurcated rod connectd to the first handle portion and in engagement with the tranverse pin, and spring means in engagement with said cylinder and said rod urging the cylinder away from the handle.

10. An underwater gun comprising a head and a handle attached to the head, a rotatable cylinder in the head, said cylinder including a plurality of chambers, a back plate on the handle and at least two arms pivotably attached to the back plate and engageable with the cylinder, rotatable means extending through the handle and back plate and in engagement with the cylinder, said rotatable means attached to a portion of said handle rotatable reltive to the back plate, a lock ring on said back plate, said lock ring engageable with the arms to cause engagement of the arms with the cylinder to thereby retain the cylinder in the head, and, springs engaging the arms and urging the arms outwardly out of engagement with the cylinder.

11. The underwater gun of claim 10 wherein the engagement of said cylinder with the arms includes indexing means, said indexing means providing alignment of each chamber sequentially with a firing position.

12. The underwater gun of claim 11 wherein said indexing means includes alignment of the cylinder in a safety position.

13. The underwater gun of claim 10 wherein each chamber includes a sleeve, the outside of each sleeve being at least partially exposed and engageable with said arms, said engagements providing indexing alignment means to align the chambers sequentially with a firing position.

14. The underwater gun of claim 13 wherein said arm engagements include indexing engagement between said sleeves to provide safety positions for said cylinder.

15. The underwater gun of claim 10 including spring means in engagement with the cylinder, said spring means urging the cylinder away from the back plate.

16. In a multi-chambered underwater gun comprising a head containing a rotatable chambered cylinder and a handle extending from the back of the head, the improvement comprising a plurality of arms adapted to engage and removably retain the cylinder in the head, said engagement of the arms with the cylinder including means to index the rotation of the cylinder to thereby align sequentially the chambers with a firing position.

17. The underwater gun of claim 16 wherein the means to index the rotation of the cylinder include means to index the cylinder to intermediate safety positions.

18. The underwater gun of claim 16 wherein said handle includes means to rotate the cylinder relative to the arms.

* * * * *